US011608829B2

(12) United States Patent
Rong et al.

(10) Patent No.: US 11,608,829 B2
(45) Date of Patent: Mar. 21, 2023

(54) STRUCTURE OF ROTOR CONNECTION OF MULTI-AXIAL MULTI-STAGE ROOTS PUMP

(71) Applicant: OVG Vacuum Technology (Shanghai) Co., Ltd., Shanghai (CN)

(72) Inventors: Yi Rong, Shanghai (CN); Yue Li, Shanghai (CN); Miaole Shen, Shanghai (CN)

(73) Assignee: OVG VACUUM TECHNOLOGY (SHANGHAI) CO., LTD., Shanghai (CN)

( * ) Notice: Subject to any disclaimer, the term of this patent is extended or adjusted under 35 U.S.C. 154(b) by 0 days.

(21) Appl. No.: 17/030,816

(22) Filed: Sep. 24, 2020

(65) Prior Publication Data

US 2021/0108636 A1 Apr. 15, 2021

(30) Foreign Application Priority Data

Oct. 10, 2019 (CN) ..... 201910960214.6

(51) Int. Cl.

| | |
|---|---|
| ***F01C 1/08*** | (2006.01) |
| ***F03C 2/00*** | (2006.01) |
| ***F03C 4/00*** | (2006.01) |
| ***F04C 15/00*** | (2006.01) |
| ***F04C 2/00*** | (2006.01) |
| ***F04C 2/18*** | (2006.01) |
| *F04C 11/00* | (2006.01) |

(52) U.S. Cl.

CPC ..... *F04C 15/0076* (2013.01); *F04C 2/18* (2013.01); *F04C 11/001* (2013.01); *Y10T 403/7024* (2015.01)

(58) Field of Classification Search

CPC ..... F04C 18/084; F04C 18/126; F04C 18/14; F04C 18/18; F04C 2/126; F04C 2/18; F04C 11/001; F04C 15/0076; F04C 23/001; F04C 2240/20; F03C 2230/90; F03C 2230/91; F05C 2201/0439; Y10T 403/7024; Y10T 403/7021; F16D 1/0888; F16D 1/0886

See application file for complete search history.

(56) References Cited

U.S. PATENT DOCUMENTS

| | | | | |
|---|---|---|---|---|
| 2,332,271 | A * | 10/1943 | Shaw | Y10T 103/7021 403/356 |
| 2,694,978 | A | 11/1954 | Berry | |
| 4,022,553 | A | 5/1977 | Poole et al. | 418/183 |
| 4,171,939 | A * | 10/1979 | Harwath | F04C 15/0073 418/170 |

(Continued)

FOREIGN PATENT DOCUMENTS

| | | | |
|---|---|---|---|
| CN | 2667203 Y | 12/2004 | F04C 18/08 |
| CN | 201396281 Y | 2/2010 | F04C 18/14 |

(Continued)

*Primary Examiner* — Theresa Trieu

(74) *Attorney, Agent, or Firm* — Renner, Kenner, Greive, Bobak, Taylor & Weber

(57) ABSTRACT

A structure comprising a rotor body, the rotor body including a rotor shaft arranged on one end face of the rotor body, a sub-shaft cavity opened in the rotor shaft, and locating keyways symmetrically opened on both sides inside the sub-shaft cavity; a sub-shaft arranged on the other end face of the rotor body, and sub-shaft locating keyways symmetrically opened on both sides of the sub-shaft.

9 Claims, 4 Drawing Sheets

(56) References Cited

U.S. PATENT DOCUMENTS

| | | | | |
|---|---|---|---|---|
| 4,595,349 | A | 6/1986 | Preston et al. | 418/206 |
| 4,728,271 | A * | 3/1988 | Harwath | F16D 1/06 403/248 |
| 4,958,997 | A * | 9/1990 | Harwath | Y10T 103/7021 403/356 |
| 4,995,796 | A | 2/1991 | Kambe et al. | 418/9 |
| 5,090,879 | A | 2/1992 | Weinbrecht | 418/9 |
| 5,335,640 | A | 8/1994 | Feuling | 123/559.1 |
| 7,255,541 | B2 | 8/2007 | Kuramoto et al. | 417/410.3 |
| 8,082,784 | B2 | 12/2011 | Grzeslo | 73/261 |
| 8,215,937 | B2 | 7/2012 | Inagaki et al. | 418/206.7 |
| 8,308,458 | B2 | 11/2012 | Kettlewell et al. | 418/19 |
| 8,500,422 | B2 | 8/2013 | Dowdeswell et al. | 418/9 |
| 8,579,601 | B2 | 11/2013 | Kim | 417/251 |
| 9,062,675 | B2 | 6/2015 | Dixon et al. | F04C 15/0015 |
| 9,080,571 | B2 | 6/2015 | Downham et al. | F04C 29/04 |
| 9,745,978 | B2 | 8/2017 | Kobus et al. | F04C 15/0096 |
| 10,738,778 | B2 | 8/2020 | Hirano et al. | F04C 18/126 |
| 2005/0069440 | A1 | 3/2005 | Naito | 418/9 |
| 2006/0222506 | A1 | 10/2006 | Rival | 417/2 |
| 2010/0135839 | A1 | 6/2010 | Fraser | 418/197 |
| 2013/0336828 | A1* | 12/2013 | Ohta | F04C 18/086 418/9 |
| 2017/0298733 | A1 | 10/2017 | Williams et al. | F01C 1/126 |
| 2019/0309756 | A1 | 10/2019 | Shaw et al. | F04D 15/0011 |

FOREIGN PATENT DOCUMENTS

| | | | | |
|---|---|---|---|---|
| CN | 101985935 B | | 3/2011 | F04C 18/14 |
| CN | 101985937 B | | 3/2011 | F04C 18/14 |
| CN | 102828952 B | | 12/2012 | F04C 25/02 |
| CN | 202690445 U | | 1/2013 | F04C 23/00 |
| CN | 202851357 U | | 4/2013 | F04C 18/14 |
| CN | 202867219 U | | 4/2013 | F04C 18/14 |
| CN | 103089647 B | | 5/2013 | F04C 18/14 |
| CN | 103486034 B | | 1/2014 | F04C 25/02 |
| CN | 105222980 B | | 1/2016 | G01M 9/04 |
| CN | 205383080 U | | 7/2016 | F04C 23/02 |
| CN | 105864036 A | | 8/2016 | F04C 18/12 |
| CN | 205779709 U | | 12/2016 | F04C 23/00 |
| CN | 106499631 A | | 3/2017 | F04C 18/12 |
| CN | 106949050 B | | 7/2017 | F04C 18/12 |
| CN | 107061284 A | | 8/2017 | F04C 25/02 |
| CN | 206377025 U | | 8/2017 | F04C 18/04 |
| CN | 108317080 A | | 7/2018 | F04C 18/12 |
| CN | 108799112 B | | 11/2018 | F04C 18/12 |
| CN | 108953146 A | | 12/2018 | F04C 18/12 |
| CN | 109026710 A | | 12/2018 | F04C 18/12 |
| CN | 109058110 A | | 12/2018 | F04C 18/12 |
| CN | 209414166 U | | 9/2019 | F04C 23/00 |
| EP | 0953771 A1 | | 11/1999 | F04C 23/00 |
| EP | 2461040 A1 | | 6/2012 | F04C 18/12 |
| EP | 3434905 A1 | | 1/2019 | F04D 19/04 |
| GB | 2417757 A | | 3/2006 | F04C 18/14 |
| JP | 3-145594 | | 6/1991 | F04C 29/04 |
| JP | 09126171 A | * | 5/1997 | |
| JP | 2009287579 A | | 12/2009 | F16D 1/09 |
| WO | WO2020/160770 A1 | | 8/2020 | F01C 21/10 |

* cited by examiner

STRUCTURE OF ROTOR CONNECTION OF MULTI-AXIAL MULTI-STAGE ROOTS PUMP

TECHNICAL FIELD

The invention relates to the technical field of roots pump rotors, particularly to a structure of rotor connection of multi-axis multi-stage roots pumps.

BACKGROUND ART

The existing multi-stage roots pumps are two-axle, tri-axial and non-coaxial. The most common method of roots rotor connection is to sleeve at least two or more roots rotors on a shaft, which to form a multi-stage roots pump. The biggest advantage of connecting multiple roots rotors on one shaft is that these rotors are coaxial, and the concentricity can be guaranteed greatly, and it is easier to ensure dynamic balance and reduce accumulative error in processing. However, there are also obvious disadvantages.

Due to the structural characteristics of the roots rotor, its airflow can only flow radially, which cannot flow axially towards the screw rotor. Therefore, both end faces of a single roots rotor shaft must be blocked by a spacer, and at the same time, the shaft and the spacer need to be sealed to prevent airflow from leaking out from the seal between the shaft and the spacer. Therefore, during installation, the first-stage roots rotor shall be sleeved firstly, and then the spacer and the sealing element are installed to seal the pump cavity of the first stage. Then the roots rotor of the second stage is installed, followed by the installation of spacer and sealing element, to seal the pump cavity of the second stage, and the installation of the multi-stage roots rotor are achieved orderly.

Although the clearance reserved for each stage of the roots rotor and the end caps on both sides after the installation is completed, in actual operation, due to thermal expansion displacement and thermal stress, one end of the first-stage roots rotor shaft is fixed with ball bearing. The other side end can be displaced, to offset the thermal stress and thermal expansion displacement. For the second-stage roots rotor, both side ends of the rotor can be displaced, and the thermal displacement of the side end of the second-stage roots rotor close to the first-stage roots rotor is the total thermal displacement of the first-stage roots rotor, and the thermal displacement at the other side end of the second-stage roots rotor is: total thermal displacement of the first-stage roots rotor plus total thermal displacement of the second-stage roots rotor. In turn, the more stages of roots rotors, the thermal displacement of the both side end faces are the superposition of the total displacement of the previous roots rotors. The thermal displacement is jointly determined by the actual operating temperature and the thermal expansion coefficient of different materials at different temperatures, also due to the accumulative error of assembly, the reserved clearance required for installation is difficult to predict and control. This is the cause that the installation of multi-stage roots pumps is very difficult to adjust and fix the clearance between the roots rotor and the end face of the next multiple stages. The conventional method is to enlarge the reserved clearance, but the excessive clearance will reduce the efficiency due to backflow and increase the vibration, which directly causes the performance of the multi-stage roots vacuum pump is not up to the standard. However, even if it is adjusted according to the reserved standards, the rotors of next stages of rotors are easy to be serized and locked during actual operation, because multiple stages of rotors are on a shaft, and the thermal expansion is accumulated. The amount of reserved clearance of next stages of rotors cannot be controlled.

SUMMARY OF INVENTION

In view of the disadvantages of the prior art, the invention provides a structure of rotor connection of multi-axis multi-stage roots pump, which overcomes the disadvantages of the prior art with reasonable design, and the first-stage rotor body is limited and fixed by the bearing, while the second-stage rotor body is only radially limited by the bearing in the first-stage rotor body. The rotor shaft on the other side is also fixed and limited by the bearing, so the thermal expansion displacement and thermal stress of the second-stage rotor body are completely independent during operation. The thermal expansion displacement of the first-stage rotor body does not affect the second-stage rotor body, and it can also synchronously drive the second-stage rotor body.

In order to achieve the above objectives, the invention is achieved through the following technical solutions:

A structure of rotor connection of multi-axial multi-stage roots pump comprises a rotor body, a rotor shaft is arranged on one end face of the rotor body; a sub-shaft cavity is opened in the rotor shaft, and the sub-shaft cavity and the rotor shaft are arranged concentrically and coaxially; the locating keyways are symmetrically opened on both sides inside the sub-shaft cavity; a sub-shaft is arranged on the other end face of the rotor body, the sub-shaft and the rotor shaft are arranged concentrically and coaxially, and the sub-shafts and the sub-shaft cavities of two adjacent rotor bodies are matched, the locating keyways are symmetrically opened on both sides of the sub-shaft, and the keyways are installed and fixed through sub-rotor shaft keys (6) in the locating keyways.

Preferably, the depth of the locating keyway is less than that of the sub-shaft cavity, and the depth of sub-shaft cavity is less than the length of the rotor shaft.

Preferably, the length of the keyway on the surface of the sub-shaft is less than that of the sub-shaft.

Preferably, both the rotor shaft and the sub-shaft are made of cast iron, and the sub-shaft and the sub-shaft cavity are interference fitted.

Preferably, one end side of the sub-rotor shaft key is a plane end face, which is used for positioning with the rotor shaft, and the other end side of the sub-rotor shaft key is an arc-shaped end face, which is used for the guiding and installation of the sub-shaft.

The invention provides a structure of rotor connection of multi-axis multi-stage roots pump. It has the following beneficial effects: the rotor shafts and sub shafts of two adjacent rotor bodies are matched and assembled concentrically with the sub-rotor shaft keys, thereby ensuring that the shafts of two rotors are on the same shaft center; at the same time, after the rotor shaft and sub-shaft are installed matching with the sub-rotor shaft keys, the shaft rotation angle of two rotor bodies remains the same; moreover, because the first-stage rotor body is fixed and limited by the bearing, the second-stage rotor body is only radially limited by the bearing in the first-stage rotor body, and the rotor shaft on the other side of the second-stage rotor body is also fixed and limited by the bearing, so the thermal expansion displacement and thermal stress of the second-stage rotor body are completely independent during operation. The thermal expansion displacement of the first-stage rotor body does not affect the second-stage rotor body, and it can also synchronously drive the second-stage rotor body.

DESCRIPTION OF DRAWINGS

In order to explain the technical solutions in the invention or in the prior art more clearly, the brief introduction of drawings required in the description of the prior art is as follows.

Figure 1:
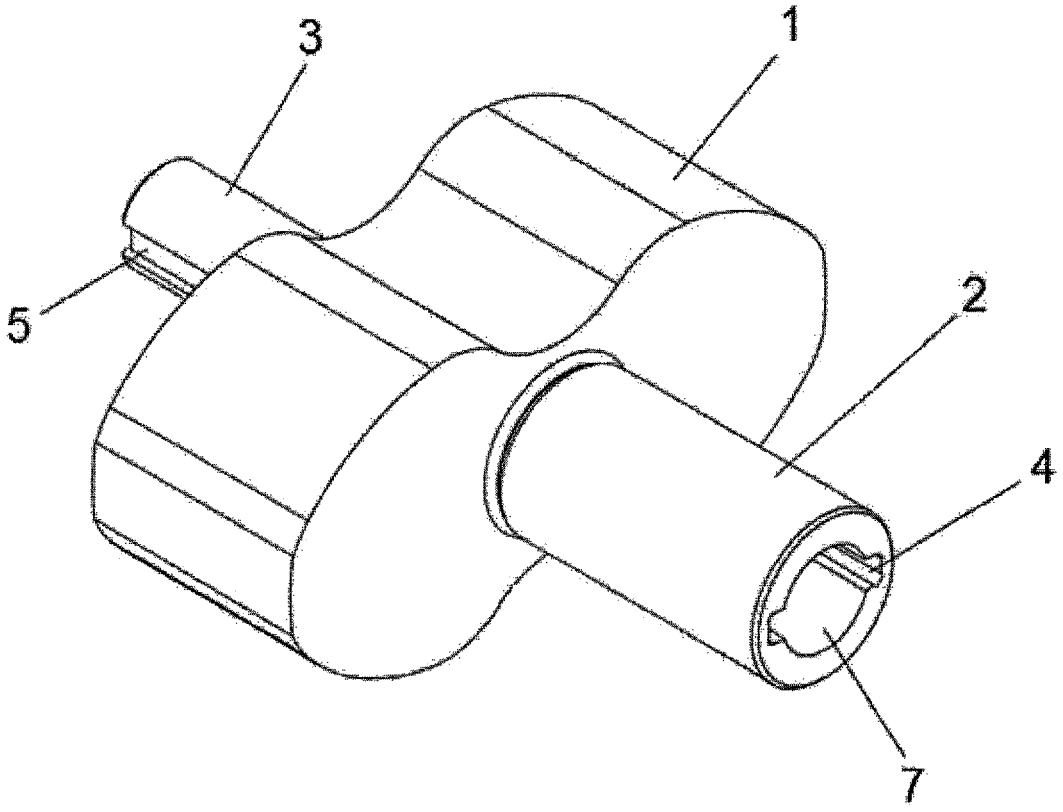
FIG. 1 is a structure diagram of the invention.

the numbers in the drawings are explained as follows:

1. Rotor body; 2. Rotor shaft; 3. Sub-shaft; 4. Locating keyway; 5. Keyway; 6. Sub-rotor shaft key; 61. Plane end face; 62. Arc-shaped end face; 7. Sub-shaft cavity.

EMBODIMENTS

In order to make the objectives, technical solutions and advantages of the invention clearer, the technical solutions in the invention will be described clearly and completely combined with the drawings in the invention.

Figure 2:
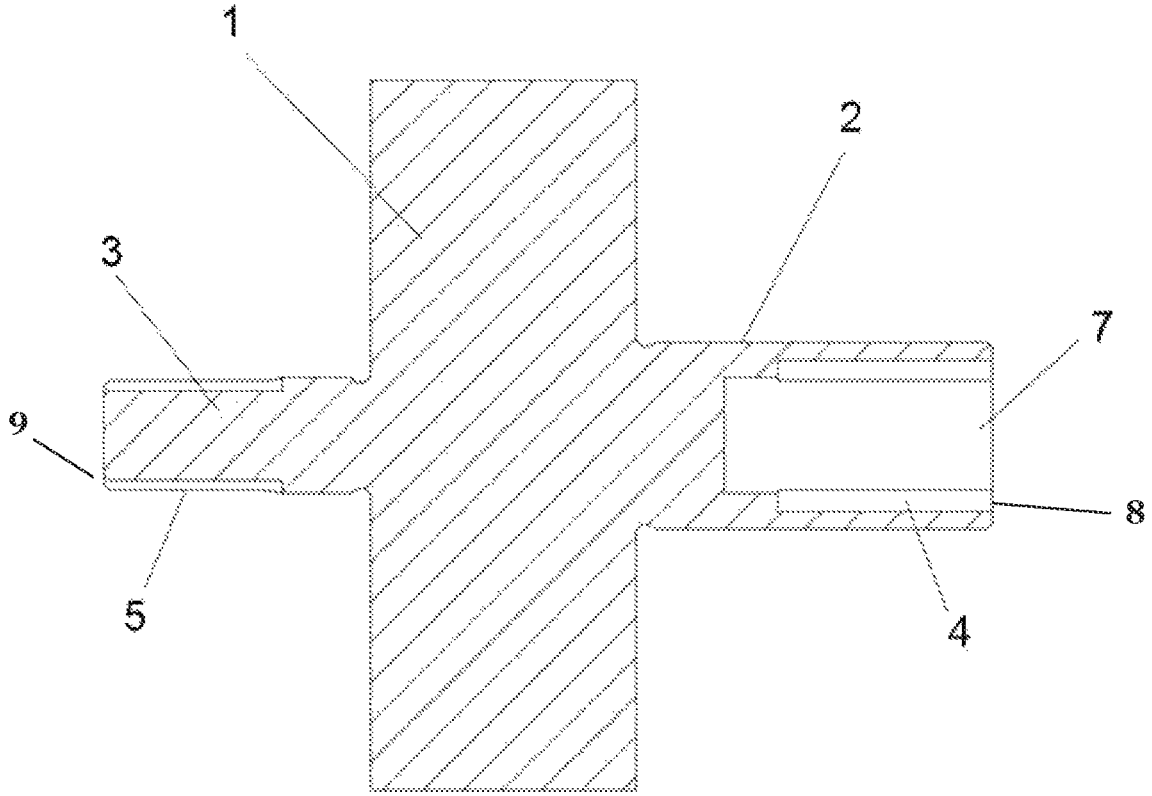
FIG. 2 is a cross-sectional view of the present invention.
Figure 3:
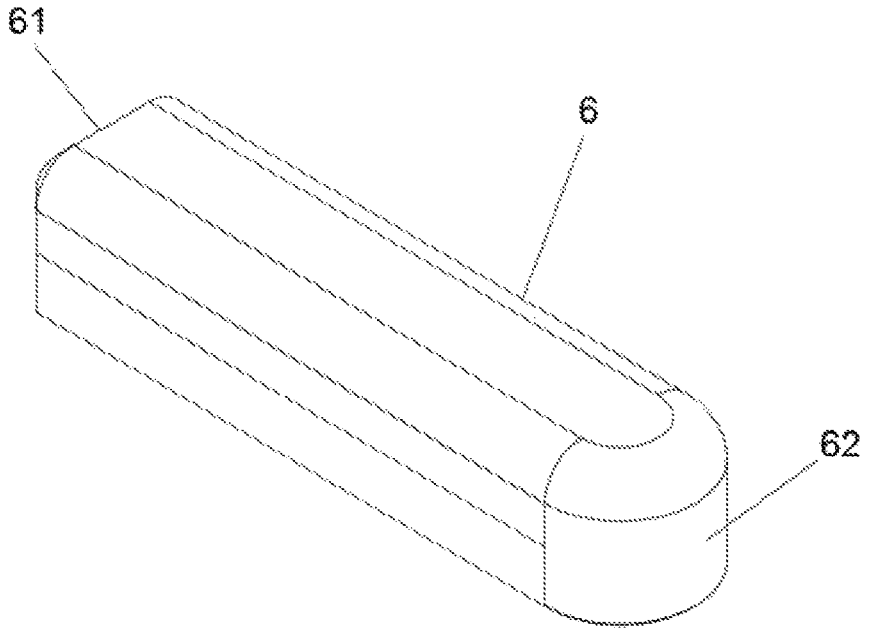
FIG. 3 is a sectional diagram of the invention.
Figure 4:
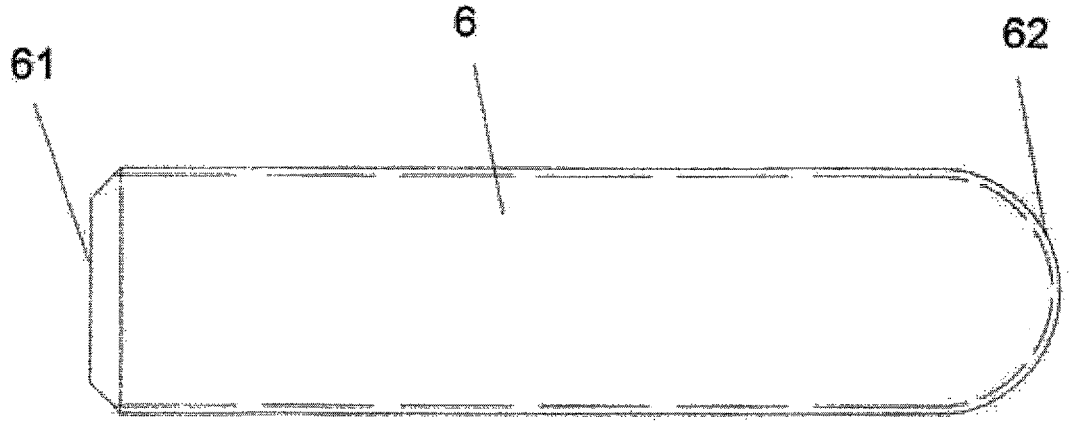
FIG. 4 is a sectional diagram of the sub-rotor shaft keys of the invention.
Figure 5:
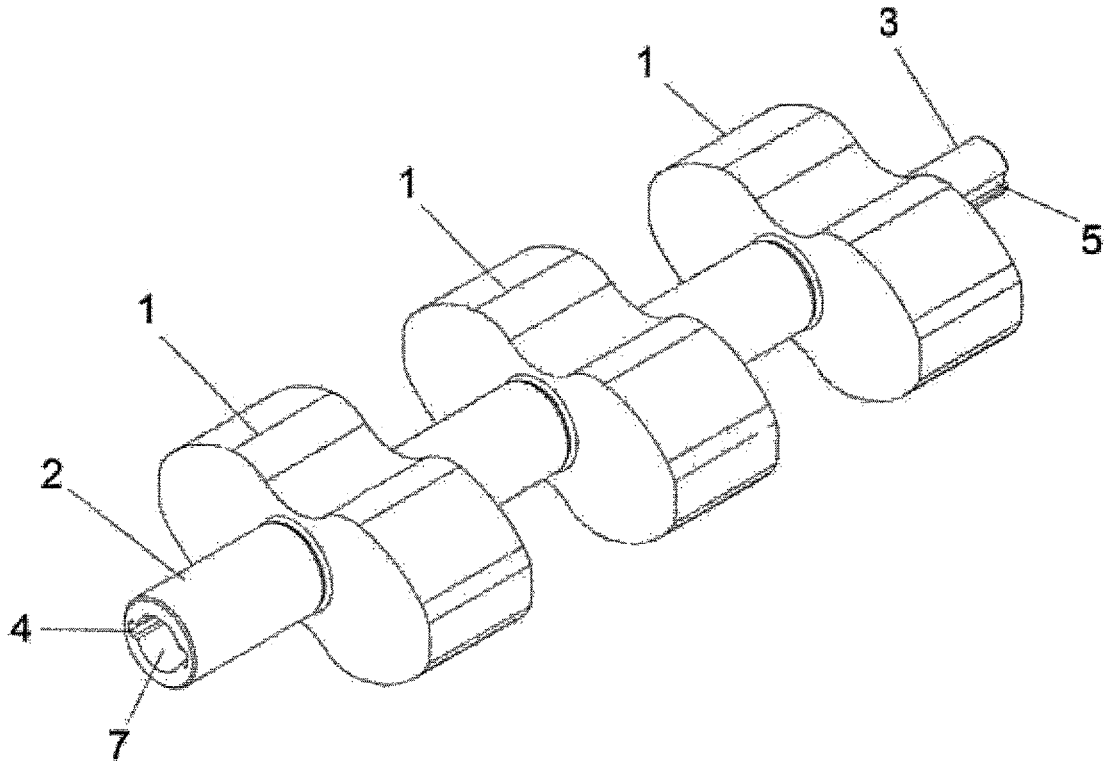
FIG. 5 is a schematic diagram of the state structure of the invention when combined.
Figure 6:
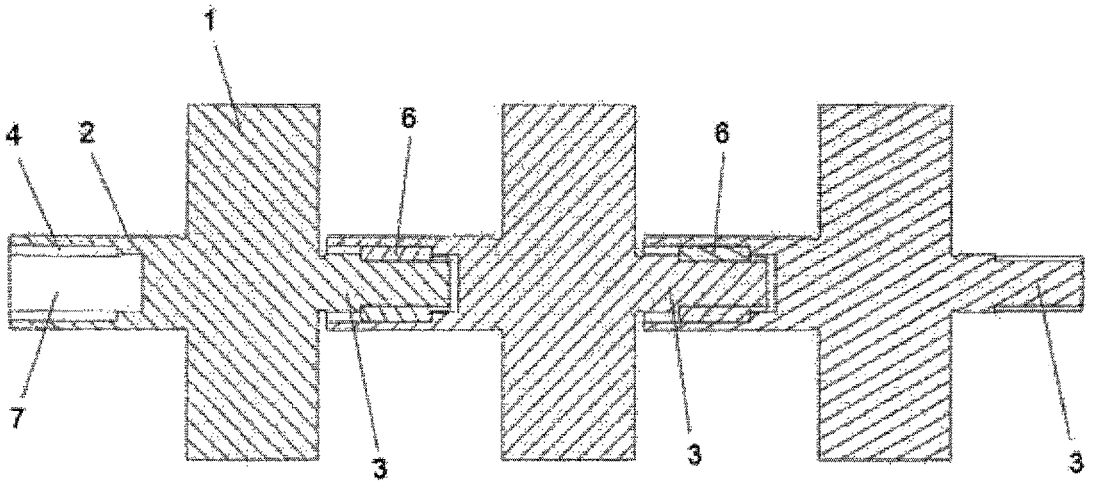
FIG. 6 is a sectional diagram I of the invention when combined.
Figure 7:
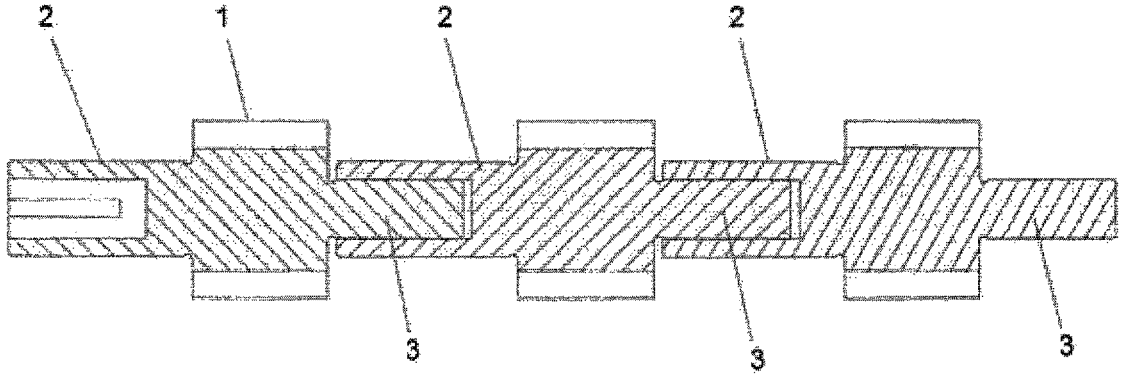
FIG. 7 is a sectional diagram II of the invention when combined.

As shown in FIG. 1-7, a structure of rotor connection of multi-axial multi-stage roots pump comprises a rotor body, a rotor shaft 2 is arranged on one end face of the rotor body 1; a sub-shaft cavity 7 is opened in the rotor shaft 2, and the sub-shaft cavity 7 and the rotor shaft 2 are arranged concentrically and coaxially; the locating keyways 4 are symmetrically opened on both sides inside the sub-shaft cavity7 beginning at an edge 8 of the sub-shaft cavity 7: a sub-shaft 3 is arranged on the other end face of the rotor body 1, the sub-shaft 3 and the rotor shaft 2 are arranged concentrically and coaxially, and the sub-shafts 3 and the sub-shaft cavities 7 of two adjacent rotor bodies 1 are matched, the sub-shaft locating keyways 5 are symmetrically opened on both sides of the sub-shaft 3 beginning at an edge 9 of the sub-shaft 3, and the sub-shaft locating keyways 5 are arranged correspondingly to the locating keyways 4, and the sub-shaft locating keyways 5 are installed and fixed through sub-rotor shaft keys 6 in the locating keyways.

In the embodiment of the invention, an integral roots pump rotor consists of a plurality of rotor bodies 1 for combination, and the size of each rotor body 1 includes the length, outer diameter and row line structure of the rotor body 1 can be different, only requiring the inner diameter of the sub-shaft cavity 7 in the rotor shaft 2 of each rotor body 1, the outer diameter of the sub-shaft 3, the locating keyway 4 in the sub-shaft cavity 7 and the keyway 5 on the outer surface of the sub-shaft 3 are consistent. Moreover, the first-stage rotor body 1 only needs a rotor shaft, and the other end face is designed as a normal shaft, which can meet the installation of gears, bearing, lock nuts and other parts.

Before multiple rotor bodies 1 are combined, the parts at one end of the normal shaft of the first-stage rotor body 1 are firstly installed to position the first-stage rotor body 1, and the bearing can also be installed on the outer surface of the rotor shaft 2 of the first-stage rotor body 1, so that the entire first-stage rotor body 1 is limited by two bearings, and then the spacer and the sealing element are installed to seal both side end faces of the first-stage roots pump cavity, so that the first-stage rotor body 1 is within an independent roots pump cavity. And the rotor shaft 2 of the first-stage rotor body 1 is reserved on the spacer for connecting with the sub-shaft of the second-stage rotor body 1.

When multiple rotor bodies 1 is combined, two sub-rotor shaft keys 6 are firstly installed in the rotor shaft 2 of the first-stage rotor body 1, and make the rotor shaft keys 6 correspond to the locating keyways 4, and then let the keyway 5 on the surface of the sub-shaft 3 of the second-stage rotor body 1 align with the two sub-rotor shaft keys 6 already installed in the rotor shaft 2 of the first-stage rotor body 1, to ensure that the sub-shaft 3 is inserted into the rotor shaft 2, and the rotor shaft 2 and the subshaft 3 are assembled concentrically, thereby ensuring that the shafts of both rotors are on the same shaft center; at the same time, after the rotor shaft 2 and sub-shaft 3 are installed matching with the sub-rotor shaft keys 6, the shaft rotation angle of two rotor bodies 1 remains the same; and in order to further increase the rotation angle of the shaft during rotation and eliminate the accumulative error, after several rotors are meshed and assembled together, the outer circular lines of several rotor bodies 1 can be integrally machined to ensure the rotation angles of the shafts of the rotor bodies 1 are completely the same.

After the sub-shaft 3 of the second-stage rotor body 1 is inserted into the rotor shaft 2 of the first-stage rotor body 1, due to the first-stage rotor body 1 is fixed and limited by the bearing (including axial and radial directions), while it is only radially limited by the bearing in the first-stage rotor body 1, and similarly, the rotor shaft 2 on the other side of the second-stage rotor body 1 is also fixed and limited by the bearing (including axial and radial directions). So the thermal expansion displacement and thermal stress of the second-stage rotor body 1 are completely independent during the operation, and the thermal expansion displacement of the first-stage rotor body does not affect the second-stage rotor body, and it can also synchronously drive the second-stage rotor body; similarly, the sub-shaft 3 of the third-stage rotor body is inserted into the rotor shaft 2 of the first-stage rotor body 1 in the same way; each rotor body 1 of the multi-stage roots pump is independently fixed and the thermal expansion displacement is also independent without accumulative superposition. Therefore, as long as the accuracy meets the requirements, the number of stages of the multi-stage roots pump can be more, not affected by thermal expansion displacement and thermal stress.

Further, the depth of the locating keyway 4 is less than that of the sub-shaft cavity 7, and the depth of the sub-shaft cavity 7 is less than the length of the rotor shaft 2. And ensure that the excircle of the rotor shaft 2 is continuous, without notch in the arc surface of the outermost circle. Because the depth of the sub-shaft cavity 7 cannot reach the root of the rotor shaft 2, the strength of the rotor shaft 2 can be guaranteed. When driving, the rotor shaft 2 will not be tore at the root of the rotor body 1 due to the angular rotation force.

Further, the length of the keyway 5 on the surface of the sub-shaft 3 is less than that of the sub-shaft 3, and ensure that the excircle of the sub-shaft 3 is continuous, without notch in the arc surface of the outermost circle. Because the length of the keyway 5 does not reach the root of the sub-shaft 3, the strength of the sub-shaft 3 can be guaranteed. When driving, the sub-shaft 3 will not be tore at the root of the rotor body 1 due to the angular rotation force.

Further, both the rotor shaft 2 and the sub-shaft 3 are made of cast iron, and the sub-shaft 3 and the sub-shaft cavity 7 are interference fitted. Thus, it is possible to satisfy that the sub-shaft 3 is smoothly inserted into the rotor shaft 2 without adhesion.

Further, one end side of the sub-rotor shaft key 6 is a plane end face 61, which is used for positioning with the rotor shaft 2, so that when the sub-shaft key 6 is installed in the locating keyway 4, the flat end surface 61 can fit with the end faces of the locating keyway 4; and the other end side of the sub-rotor shaft key 6 is an arc-shaped end face 62, which can play a certain role in installation and guidance when the sub-shaft 3 is inserted into the rotor shaft 2; Moreover, The driving achieved by meshing with the rotor shaft 2 is to drive the upper side and top surface of both ends of the sub-rotor shaft key 6, and the driving achieved by meshing with the rotor shaft 3 is the lower side and bottom surfaces of the both ends of the sub-rotor shaft key 6.

The above embodiments are only used to explain the technical solution of the invention, but not to limit it; although referring to the aforesaid embodiments, the invention has been described in detail, those skilled in the art shall understand that the technical solutions described in the aforesaid embodiments can still be modified, or some of the technical features are equivalently replaced; and these modifications or replacements shall not make the essence of the corresponding technical solutions deviate from the spirit and scope of the technical solutions of the embodiments of the invention.

The invention claimed is:

1. A structure comprising a rotor body including a rotor shaft arranged on and extending from a first end face of the rotor body; a sub-shaft cavity opened in the rotor shaft wherein the sub-shaft cavity and the rotor shaft are arranged concentrically and coaxially; a first locating keyway opened on a first side inside the sub-shaft cavity and a second locating keyway opened on a second side inside the sub-shaft cavity in a symmetrical position with said first locating keyway, wherein said first and second locating keyway each begin at an edge of the sub-shaft cavity; a sub-shaft arranged on and extending from a second end face of the rotor body, wherein the sub-shaft and the rotor shaft are arranged concentrically and coaxially; and a first sub-shaft locating keyway opened on a first side of the sub-shaft and a second sub-shaft locating keyway opened on a second side of the sub-shaft in a symmetrical position with said first sub-shaft locating keyway, and wherein said first and second sub-shaft locating keyway being at an edge of the sub-shaft.

2. The structure of claim 1, wherein a depth of each said first and second locating keyway is less than a depth of the sub-shaft cavity, and wherein the depth of sub-shaft cavity is less than a length of the rotor shaft.

3. The structure of claim 1, wherein a length of each said first and second sub-shaft locating keyway is less than a length of the sub-shaft.

4. The structure of claim 1, wherein both the rotor shaft and the sub-shaft are made of cast iron, and wherein the sub-shaft and the sub-shaft cavity are interference fitted.

5. A plurality of rotor bodies in rotor connection with one another, wherein each rotor body of the plurality of rotor bodies are characterized in that each rotor body includes a rotor shaft arranged on a first end face of each said rotor body; a sub-shaft cavity opened in the rotor shaft of each said rotor body wherein the sub-shaft cavity and the rotor shaft are arranged concentrically and coaxially within each said rotor body; a first locating keyway opened on a first side inside the sub-shaft cavity of each said rotor body and a second locating keyway opened on a second side inside the sub-shaft cavity of each said rotor body in a symmetrical position with said first locating keyway, wherein said first and second locating keyway each begin at an edge of the sub-shaft cavity of each said rotor body; a sub-shaft arranged on a second end face, opposite said first end face, of each said rotor body wherein the sub-shaft and the rotor shaft of each said rotor body are arranged concentrically and coaxially; and a first sub-shaft locating keyway opened on a first side of the sub-shaft of each said rotor body and a second sub-shaft locating keyway opened on a second side of the sub-shaft of each said rotor body in a symmetrical position with said first sub-shaft locating keyway, and wherein said first and second sub-shaft locating keyway being at an edge of the sub-shaft of each said rotor body; wherein the sub-shaft of one rotor body is securable within a sub-shaft cavity of an other rotor body adjacent said one rotor body through the use of two sub-rotor shaft keys placed within the first and second locating keyways, respectively, within the sub-shaft cavity of the other rotor body and the first and second sub-shaft locating keyways within the sub-shaft of the one rotor body.

6. The plurality of rotor bodies in rotor connection with one another of claim 5, wherein a depth of each said first and second locating keyway of each rotor body of the plurality of rotor bodies is less than a depth of the sub-shaft cavity of each rotor body of the plurality of rotor bodies, and wherein the depth of sub-shaft cavity of each rotor body of the plurality of rotor bodies is less than a length of the rotor shaft of each rotor body of the plurality of rotor bodies.

7. The plurality of rotor bodies in rotor connection with one another of claim 5, wherein a length of each said first and second sub-shaft locating keyway of each rotor body of the plurality of rotor bodies is less than a length of the sub-shaft of each rotor body of the plurality of rotor bodies.

8. The plurality of rotor bodies in rotor connection with one another of claim 5, wherein both the rotor shaft of each rotor body of the plurality of rotor bodies and the sub-shaft of each rotor body of the plurality of rotor bodies are made of cast iron, and the sub-shaft of each rotor body of the plurality of rotor bodies and the sub-shaft cavity of each rotor body of the plurality of rotor bodies are interference fitted.

9. The plurality of rotor bodies in rotor connection with one another of claim 5, wherein a first end of each sub-rotor shaft key is a plane end face utilized for positioning within the rotor shaft of the one rotor body, and a second end of each sub-rotor key is an arc-shaped end face utilized for positioning within the sub-shaft of the other rotor body.

* * * * *